US009132438B2

(12) United States Patent
Fraser et al.

(10) Patent No.: US 9,132,438 B2
(45) Date of Patent: Sep. 15, 2015

(54) COMBINED HEAD MASSAGER AND SPRAY HAIR WASHER

(71) Applicants: Rosaline Fraser, Oak Hill, VA (US); Ben Feldman, Reston, VA (US); Thomas Harrison, Centerville, VA (US)

(72) Inventors: Rosaline Fraser, Oak Hill, VA (US); Ben Feldman, Reston, VA (US); Thomas Harrison, Centerville, VA (US)

(73) Assignee: Rosaline Fraser, Oak Hill, VA (US)

( * ) Notice: Subject to any disclaimer, the term of this patent is extended or adjusted under 35 U.S.C. 154(b) by 0 days.

(21) Appl. No.: 14/201,484

(22) Filed: Mar. 7, 2014

(65) Prior Publication Data

US 2014/0263711 A1 Sep. 18, 2014

Related U.S. Application Data

(60) Provisional application No. 61/776,828, filed on Mar. 12, 2013.

(51) Int. Cl.
*B05B 1/18* (2006.01)
*A46B 13/06* (2006.01)
(Continued)

(52) U.S. Cl.
CPC ..... *B05B 1/185* (2013.01); *A46B 11/0006* (2013.01); *A46B 13/06* (2013.01); *A61H 7/005* (2013.01); *A61H 9/0021* (2013.01); *B05B 1/083* (2013.01); *B05B 1/086* (2013.01); *B05B 1/14* (2013.01); *A46B 2200/102* (2013.01); *A61H 7/003* (2013.01); *A61H 7/006* (2013.01); *A61H 2201/105* (2013.01); *A61H 2205/021* (2013.01)

(58) Field of Classification Search
CPC ..... A46B 11/0006; A46B 2200/102; B05B 1/185; B05B 1/18; A61H 9/00
USPC ..... 239/11, 304, 428.5, 378, 305, 444; 601/95, 137, 136; 4/518, 515, 517, 516
See application file for complete search history.

(56) References Cited

U.S. PATENT DOCUMENTS 3,963,179 A 6/1976 Tomaro
3,992,744 A 11/1976 Fassler
(Continued)

FOREIGN PATENT DOCUMENTS

EP 2443958 * 6/2010 ..... A45D 19/02
JP 2008-289616 * 12/2008 ..... A61H 23/02
(Continued)

OTHER PUBLICATIONS

International Search Report and the Written Opinion of the International Searching Authority from the Korean Patent Office in International Application No. PCT/US2014/022529 mailed Aug. 5, 2014.

*Primary Examiner* — Arthur O Hall
*Assistant Examiner* — Chee-Chong Lee
(74) *Attorney, Agent, or Firm* — The Marbury Law Group, PLLC

(57) ABSTRACT

An apparatus is disclosed including: a brush member including a brush member input in fluid communication with plurality of hollow bristles; and an expandable member. In some embodiments, the expandable member includes an expandable member input configured to receive a pulsating fluid flow from a fluid supply source; and a conduit having that defines a fluid flow path from the expandable member input through the conduit to the brush member input. In some embodiments the expandable member is configured to expand and contract in response to the pulsating fluid flow to cause a reciprocating motion of the brush member.

19 Claims, 12 Drawing Sheets

(51) Int. Cl.

| | |
|---|---|
| ***B05B 1/08*** | (2006.01) |
| ***B05B 1/14*** | (2006.01) |
| ***A46B 11/00*** | (2006.01) |
| ***A61H 9/00*** | (2006.01) |
| *A61H 7/00* | (2006.01) |

(56) References Cited

U.S. PATENT DOCUMENTS

| | | | | |
|---|---|---|---|---|
| 4,141,502 | A | 2/1979 | Grohe | |
| 5,097,540 | A * | 3/1992 | Lovitt | 4/443 |
| 5,109,553 | A * | 5/1992 | Kishimoto | 4/518 |
| 5,649,502 | A | 7/1997 | Frank | |
| 6,267,305 | B1 | 7/2001 | Kondo | |
| 6,308,717 | B1 | 10/2001 | Vrtaric | |
| 6,412,125 | B1 | 7/2002 | Ito et al. | |
| 8,336,558 | B2 | 12/2012 | Hurwitz | |
| 8,360,668 | B1 | 1/2013 | Hinnant | |
| 2001/0034497 | A1 * | 10/2001 | Bak | 601/134 |
| 2003/0172947 | A1 | 9/2003 | Wang | |
| 2008/0234611 | A1 | 9/2008 | Sakai et al. | |
| 2011/0067717 | A1 | 3/2011 | McHugh | |
| 2012/0159724 | A1 | 6/2012 | Houman | |
| 2012/0222695 | A1 | 9/2012 | Suter | |

FOREIGN PATENT DOCUMENTS

| | | | |
|---|---|---|---|
| KR | 20-0430066 | | 11/2006 |
| KR | 10-2013-0009078 | A | 1/2013 |
| WO | 2006112309 | A2 | 10/2006 |

* cited by examiner

COMBINED HEAD MASSAGER AND SPRAY HAIR WASHER

CROSS REFERENCE TO RELATED APPLICATIONS

The present application claims the benefit of U.S. Provisional Application Ser. No. 61/776,828, filed Mar. 12, 2013, the entire contents of which are incorporated herein by reference.

BACKGROUND

The present disclosure generally relates to spray hair washer imbedding head massaging features and, more specifically, to an assembly of combined head massager and spray hair washer designed for effective washing of hair extensions and hairpieces secured on a human head.

Washing human hair and scalp for those who have hair extensions and hairpieces may be a difficult or sometimes impossible task. Today, most hair extensions or hairpieces can be attached to the naturally growing hair by braiding or gluing, which may create problems with maintaining and keeping the scalp and the hair extensions clean. The washing devices currently in the market may not provide effective and efficient results when washing scalp, due to the layers between the hair and scalp.

SUMMARY

In one aspect, a massage showerhead is disclosed including: a main body container having at least one surface, the main body container is configured to be connected to a water supply source; a plurality of hollow bristles projecting outwards from the at least one surface; a plurality of hollow projections extending outward from the at least one surface, wherein each hollow projection is slidably mounted within one of the plurality of hollow bristles, the plurality of hollow projections being in water communication with the water chamber; a turbine mechanism positioned in the main body container and having at least one shaft, wherein the turbine mechanism is configured to rotate the at least one shaft by water entering the main body container. In some embodiments, the shaft is further configured to periodically move the plurality of hollow projections within the plurality of hollow bristles back and forth.

In some embodiments, the plurality of hollow projections is further configured to transmit the water flow from the main body container outwards. In some embodiments, the plurality of hollow bristles includes bristles of variable length. In some embodiments, the plurality of hollow bristles includes bristles of variable curvature. In some embodiments, the plurality of hollow projections includes projections of variable length. In some embodiments, the plurality of hollow projections includes projections of variable curvature.

In some embodiments, the at least one surface of the main body container has a curved shape.

In some embodiments, the turbine mechanism includes at least one water turbine, which is configured to rotate the at least one shaft when affected by the action of the water flow.

Some embodiments include a water channel for producing rotary water motion within the main body container.

In some embodiments, the at least one shaft further includes a crankshaft. In some embodiments, the crankshaft includes a plurality of pistons being in communication with the plurality of plurality of hollow projections.

Some embodiments include a sealing member for sealing a space between the plurality of bristles and corresponding hollow projections positioned therein.

Some embodiments include a water pressure regulator or a faucet.

Some embodiments include one or more receptacles for holding liquid shampoo, conditioning or treatment liquids.

Some embodiments include a liquid dispenser, which includes a dispensing valve, which when urged under an elastic biasing force, provides a liquid communication from the one or more receptacles to the main body container.

Some embodiments include a nozzle for coupling to a faucet.

In some embodiments, the main body container is in liquid communication with the plurality of hollow projections.

Some embodiments include a hose and/or a handle.

In another aspect, a massage showerhead is disclosed including: a main body container having at least one surface, the main body container is configured to be connected to a water supply source; a plurality of hollow bristles projecting outwards from the at least one surface; a plurality of hollow projections extending outward from the at least one surface, where each hollow projection is slidable and mounted within one of the plurality of hollow bristles, the plurality of hollow projections being in water communication with the water chamber; a turbine mechanism positioned in the main body container and having at least one shaft, wherein the turbine mechanism is configured to rotate the at least one shaft by water entering the main body container. In some embodiments, the shaft is further configured to circularly move the plurality of hollow projections within the plurality of hollow bristles.

In another aspect, an apparatus is disclosed including: a brush member including a brush member input in fluid communication with plurality of hollow bristles; and an expandable member. In some embodiments, the expandable member includes an expandable member input configured to receive a pulsating fluid flow from a fluid supply source; and a conduit that defines a fluid flow path from the expandable member input through the conduit to the brush member input. In some embodiments the expandable member is configured to expand and contract in response to the pulsating fluid flow to cause a reciprocating motion of the brush member.

Some embodiments include a connector configured to attach the expandable member input to the fluid supply source.

In some embodiments, the connector includes a rigid member. In some embodiments the connector includes a ring clamp adapted to clamp the expandable member to one or more surfaces of the fluid supply source.

In some embodiments the expandable member is an elastic member. In some embodiments, the expandable member includes a pleated accordion feature.

In some embodiments the fluid supply source includes a showerhead including a pulsation device configured to generate the pulsating fluid flow. In some embodiments, the apparatus includes the showerhead.

In some embodiments, the brush member includes a main body having at least one surface, and where each one of the bristles from the plurality of bristles project outward from the surface. In some embodiments, the plurality of hollow bristles includes bristles of variable length. In some embodiments the plurality of hollow bristles includes bristles of variable curvature. In some embodiments the at least one surface of the main body of the brush member has a curved shape.

In some embodiments, the expandable member includes a diaphragm adapted to receive the main body of the brush member, where the diaphragm includes a plurality of holes through which each of the plurality of hollow bristles extends.

In some embodiments, the brush member is a rigid member.

In some embodiments, the connector, expandable member, and brush member are disposed about a longitudinal axis extending from a first end proximal the fluid supply source to a second end distal the fluid supply source, and the reciprocating motion of the brush member includes reciprocation towards and away from the first end proximal the fluid supply source.

In another aspect a method is disclosed including: providing an apparatus including: a brush member including a brush member input in fluid communication with plurality of hollow bristles; and an expandable member including: an expandable member input configured to receive a pulsating fluid flow from a fluid supply source; and a conduit having that defines a fluid flow path from the expandable member input through the conduit to the brush member input. The method further includes providing a pulsating fluid flow to the expandable member input to cause the expandable member to alternately expand and contract in response to a pulsating fluid flow; and causing a reciprocating motion of the brush member in response to the pulsating fluid flow.

Some embodiments include outputting fluid through the plurality of hollow bristles during the reciprocating motion of the brush member.

Some embodiments include receiving a steady fluid flow from a steady fluid flow source; and generating the pulsating fluid flow from the steady fluid flow.

In some embodiments, the generating the pulsating fluid flow from the steady fluid flow includes: providing a showerhead including a pulsation device; and directing the steady fluid flow to the pulsation device to generate a pulsating fluid flow.

Various embodiments may include any of the above described features or elements, alone or in any suitable combination.

BRIEF DESCRIPTION OF THE DRAWINGS

FIG. 3A is a perspective view. FIG. 3B is a side view. FIG. 3C is a side cross sectional view through section A-A in FIG. 3B.

FIG. 4A is a perspective view. FIG. 4B is a side view. FIG. 4C is a top view.

FIG. 5A is a perspective view. FIG. 5B is a side view. FIG. 5C is a side cross sectional view through section A-A in FIG. 5B. FIG. 5D is top view.

Although FIGS. 3A-5D include various exemplary dimensions (in arbitrary units), it is to be understood that in various embodiments any other suitable dimensions may be used.

DETAILED DESCRIPTION

According to one or more embodiments of the present disclosure, a massage showerhead and related devices are provided, which combines a head massager and a spray hair washer for use in, e.g., hair salons and homes. Embodiments disclosed herein are advantageous or ideal for washing heads, hair and scalps for human with or without hair extensions or hairpieces.

Figure 1:
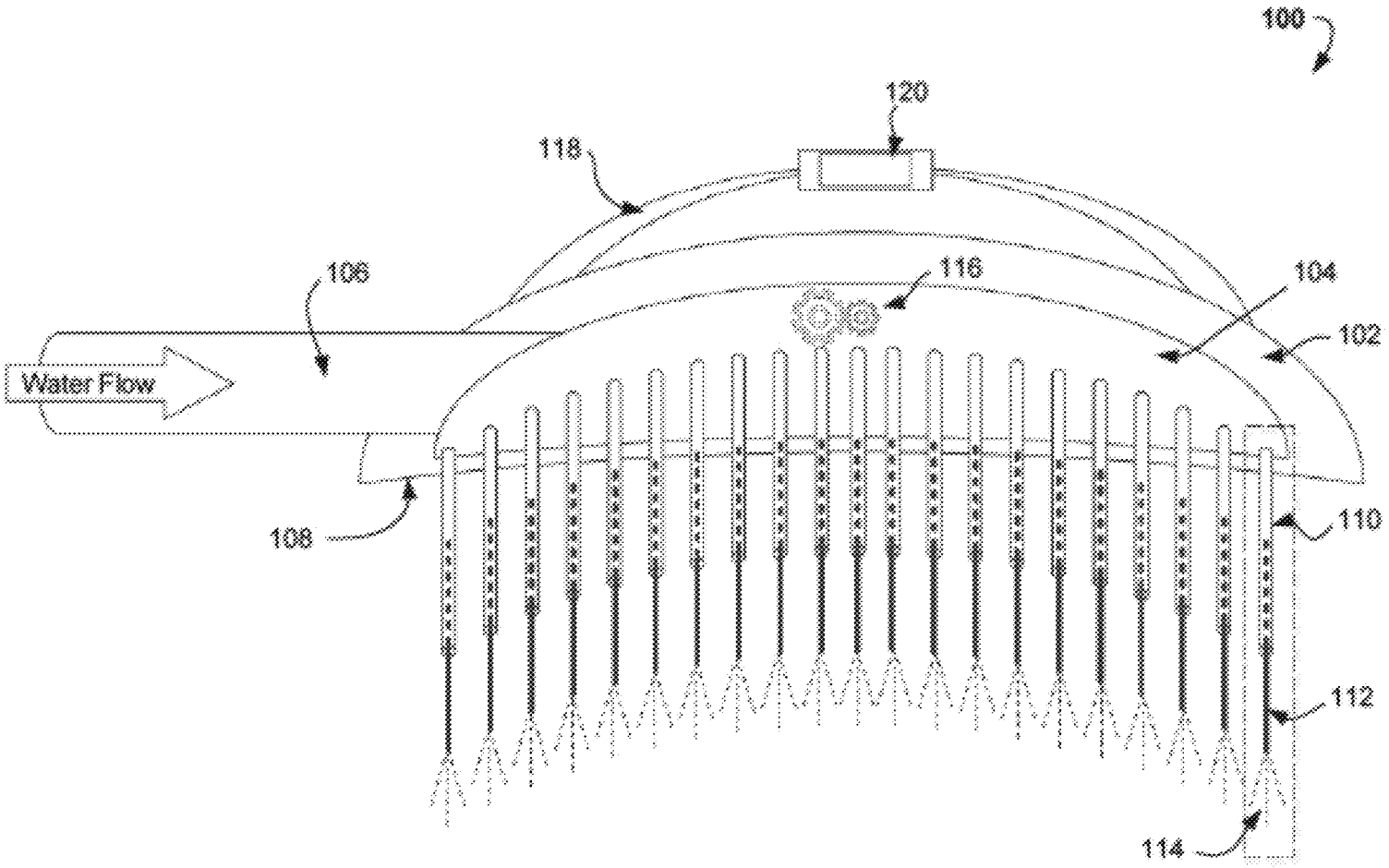
FIG. 1 shows a high level diagram of a massage showerhead.

FIG. 1 shows a high level diagram of a massage showerhead 100 according to an example embodiment. More specifically, this figure shows a simplified diagram of a longitudinal cross section of the massage showerhead 100 for illustrative purposes and explaining the principles of operation.

The massage showerhead 100 may have a main body container 102, which includes a water chamber 104 therein. The main body container 102 may be in liquid communication with a hollow handle 106, which in turn may be connected to a water source to deliver water from the water source into the water chamber 104. In an example embodiment, the hollow handle 106 may be operatively coupled with a hose (e.g., a 42 inch hose). The hose may be configured to connect to a faucet or water valve (both not shown). For example, the hose or the handle 106 may have a dedicated nozzle for connecting to a faucet. The arrow on FIG. 1 illustrates a water flow entering the massage showerhead 100.

The massage showerhead 100 may have a hemispheric or similar shape and may have at least one water spray surface 108. As shown in FIG. 1, there is provided a plurality of hollow bristles 110 having substantially tubular form extending outwards from the water spray surface 108. In the shown example, the plurality of hollow bristles 110 is perpendicular to the water spray surface 108. However, in certain embodiments, the plurality of hollow bristles 110 may be inclined towards the water spray surface 108. Furthermore, it should be noted that the plurality of hollow bristles 110 may have variable shapes, curvatures, diameters, and/or lengths. In some embodiments, however, the plurality of hollow bristles 110 may have equal shapes, curvatures, diameters, and/or lengths. In the example shown in FIG. 1, the plurality of hollow bristles 110 has variable lengths, but all of them have equally straight tubular protrusions. Furthermore, it should be noted that in certain embodiments the plurality of hollow bristles 110 may have variable elasticity.

Still referencing FIG. 1, the massage showerhead 100 may include a plurality of hollow projections 112, which are slidably positioned within the hollow bristles 110. In operation, as will be described below, the plurality of hollow projections 112 may move back and forth within the hollow projections 112 under the action of water flow. In addition, the tubular shape of the hollow projections 112 allows water to flow from the water chamber 104 out, e.g. towards the user head or scalp (not shown). The reference number 114 illustrates the water flow (e.g., jet streams) running out from the hollow projections 112. In certain embodiments, the plurality of projections may also provide rotational or circulatory motions under the action of the water flow.

It should be also noted that the plurality of hollow projections 112 may have variable shape, curvature, diameter, and/or length. In some embodiments, however, the plurality of projections 112 may have equal shape, curvature, diameter, and/or length. In the example shown in FIG. 1, the plurality of hollow projections 112 has equal length and equal straight tubular design.

Furthermore, it should be noted that in certain embodiments the plurality of hollow projections 112 may have variable elasticity.

In general, the dimensions of the hollow bristles 110 and/or the hollow projections 112 allow for easy penetration of meshes or gaps found between interlocks of hair extensions, or in hair weaves or hair pieces for massaging and washing the users' head scalp. The dimensions and shapes of the hollow bristles 110 and/or the hollow projections 112 should be suitable to fit through various sizes of hair extension meshes and wefting, and the gaps between the interlocks, without damaging them, especially the delicate lace meshes found on men's hairpieces.

Still referencing to FIG. 1, the massage showerhead 100 may include a turbine mechanism 116, which is positioned inside the water chamber 104. Generally speaking, the turbine mechanism 116 is configured to periodically move the plurality of hollow projections 112 under the action of flowing water. In certain embodiments, the turbine mechanism 116 may transform the water flow force into a kinetic force generating a circulatory or rotating motion. For example, the turbine mechanism 116 may have a turbine or waterwheel with a shaft arranged such that the water flow rotates the turbine or waterwheel, which in turn rotates the shaft. The rotation of the shaft drives the plurality of hollow projections 112 so that they move back and forth within the hollow bristles 110 and/or they rotate circularly (e.g., up to ±5 degrees) thereby effectively massaging the user scalp, while at the same time cleaning the scalp.

In certain embodiments, the massage showerhead 100 may optionally have a hand strap 118 with an optional hand strap adjustment unit 120. Furthermore, the massage showerhead 100 may optionally have a water pressure regulator, water valve or faucet (not shown) for regulating the pressure of the water flowing through the hollow projections 112 from strong to soft or vice versa.

In certain embodiments, the massage showerhead 100 may optionally have one or more receptacles (not shown) for holding shampoo, conditioning or treatment liquids/products. There may be also an option of liquid type dispenser (not shown) that may have a dispensing valve or a pumping button on top of the main body container 102. When the dispensing valve is urged under an elastic biasing force (e.g., when the button is pressed), the shampoo, conditioning or treatment liquids/products stored in the one or more receptacles may be released and delivered into the water chamber 104 for further supply to the user's hair or scalp.

According to certain embodiments of the present disclosure, at least one of the plurality of hollow bristles 110 and/or at least one of the plurality of hollow projections 112 may be replaceable. For example, there may be four sets of bristles 110 and/or projections 112 provided, that can be interchanged by the user. The user may, for example, unscrew the standard bristle/projection size of one quarter inch diameter with other bristle/projection sizes. The other bristle/projection sizes should range from one sixteenth to one eighth to one half inches.

Figure 2:
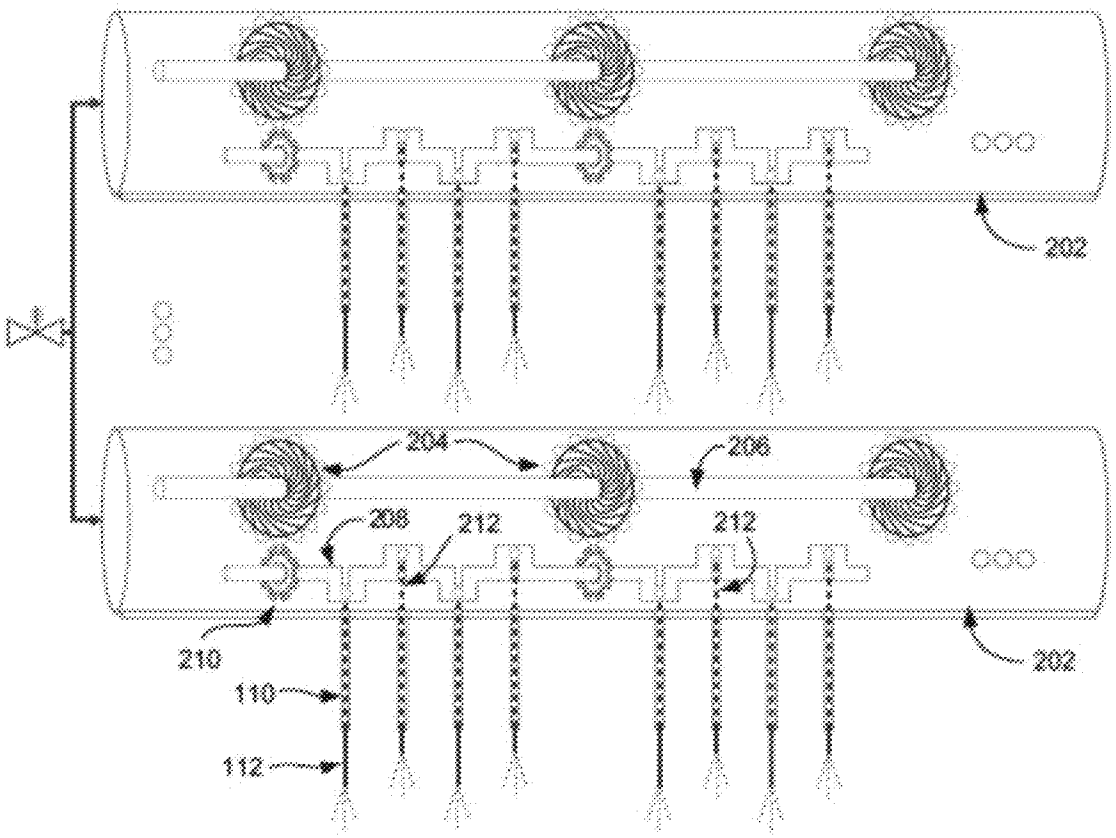
FIG. 2 shows a high level diagram of the turbine mechanism, plurality of hollow bristles, and the plurality of hollow projections of a massage showerhead.

FIG. 2 shows a high level diagram of the turbine mechanism 116 and also the plurality of hollow bristles 110 and the plurality of hollow projections 112. In particular, there are two sections 202 shown which may be embedded within the main body container 102, although there may be more or less sections 202. Each section 202 may be implemented as a water pipe, walls or a water channel of any suitable shape and design. In certain example embodiments, the sections 202 may be curved so as to produce rotary water motion within the main body container 102.

Still referencing to FIG. 2, the turbine mechanism 116 may include a plurality of turbines 204 positioned on a shaft 206. The water flow may cause the turbines 204 to rotate the shaft 206. The rotation of the shaft 206 and/or rotation of the turbines 204 may cause rotation of a crankshaft 208 (or camshaft) through the use of a gearing mechanism 210.

The crankshaft 208 may include a plurality of pistons 212 which are movably coupled to the plurality of hollow projections 112. Accordingly, when the crankshaft 208 is rotated, the pistons 212 do circulatory motion causing a linear back and forth motion of the plurality of hollow projections 112 within the hollow bristles 110. It should be noted that one group of the hollow projections 112 may move in one direction, while another group of the hollow projections 112 may move in the opposite direction.

The massage shower head 100 may also have sealing members in between various components so as to prevent water leakage. For example, there may be provided a sealing member between the hollow bristles 110 and corresponding hollow projections 112.

Figure 3A:
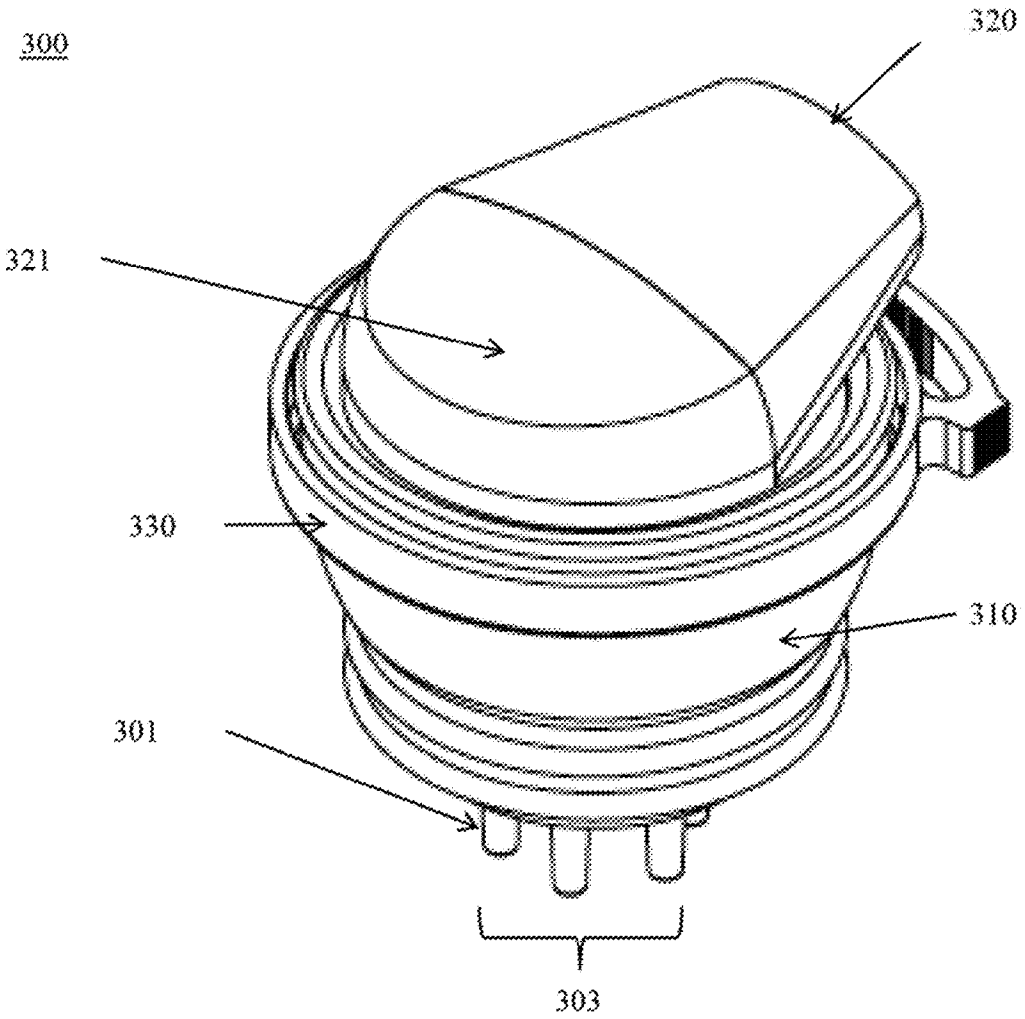
FIGS. 3A-3C show views of a massage showerhead featuring a reciprocating brush member.
Figure 3B:
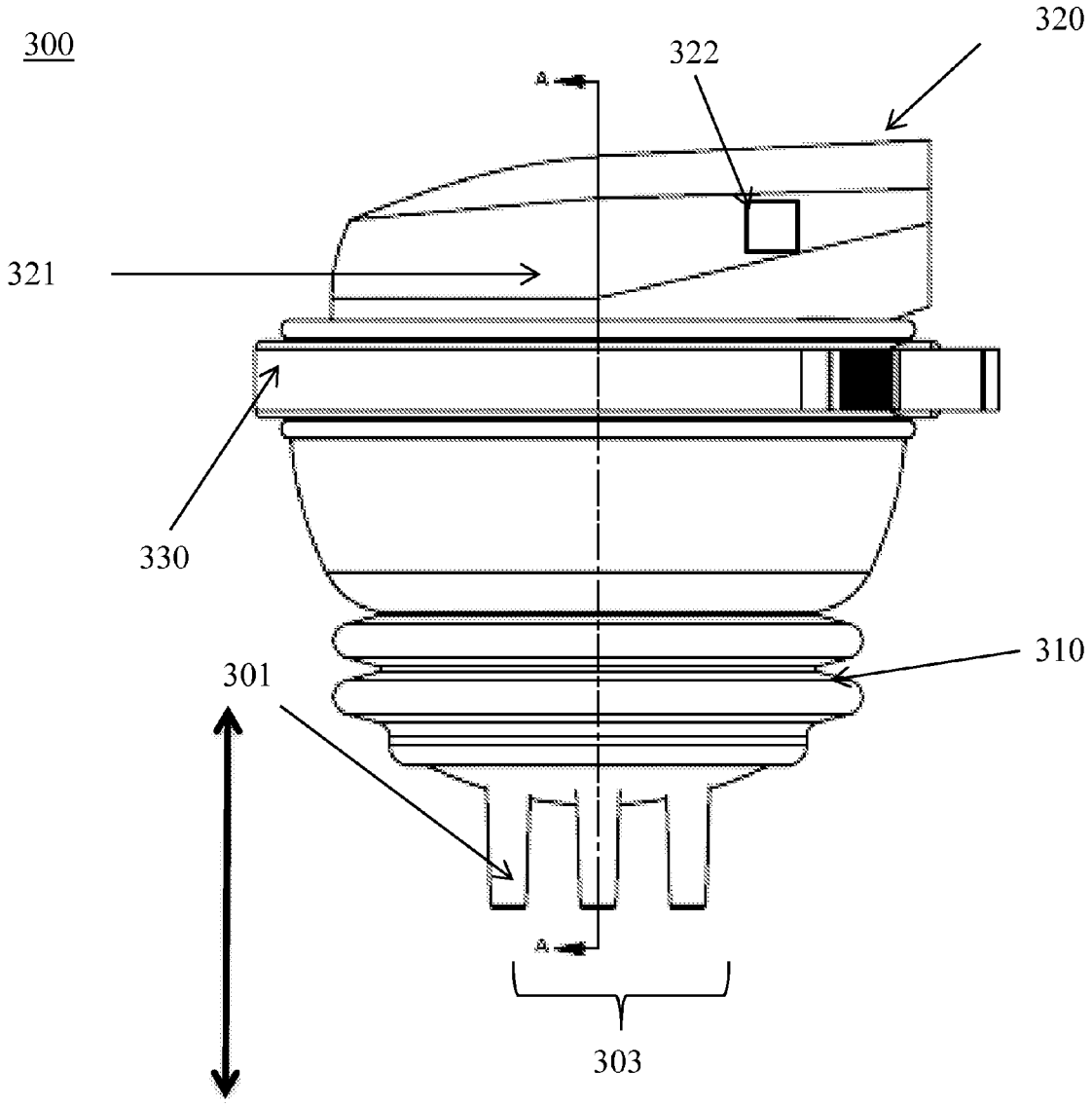
Figure 3C:
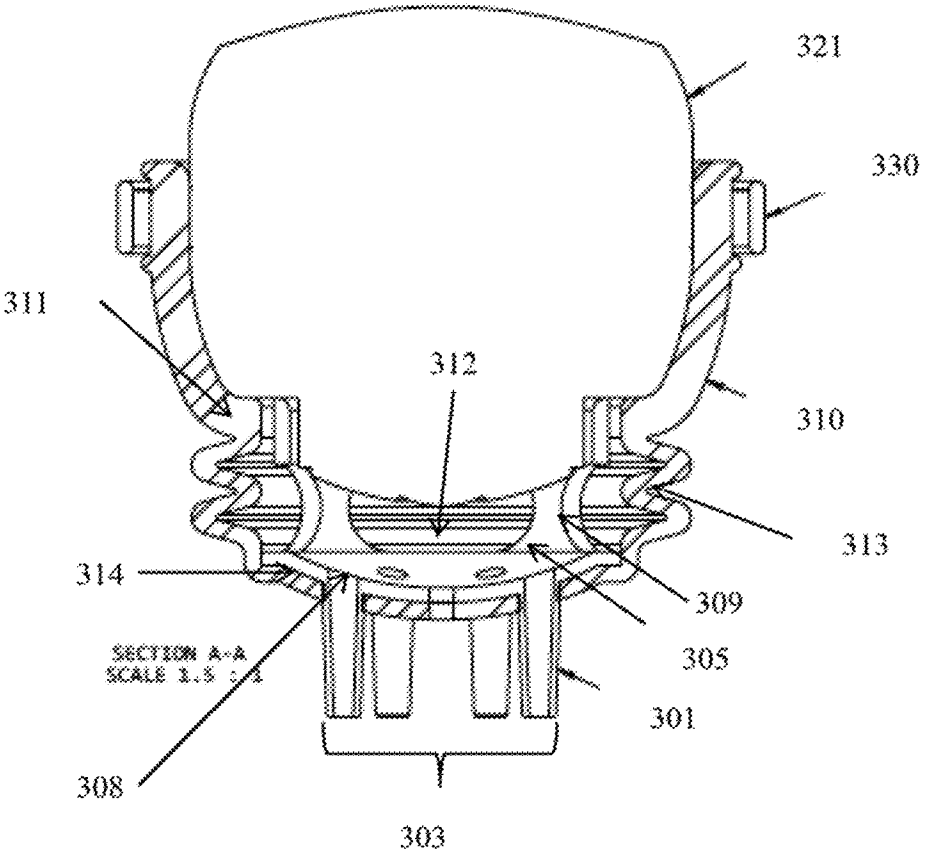

FIGS. 3A-3C illustrate a massage shower spray apparatus 300 according to another example embodiment. The apparatus 300 includes a brush member 301 (shown in detail in FIGS. 4A-4C) including a brush member input 302 in fluid communication with plurality of hollow bristles 303 that may serve as a shower spray output. An expandable member 310 (shown in detail in FIGS. 5A-5D) includes an expandable member input 311 configured to receive a pulsating fluid flow from a fluid supply source 320 (as shown, a shower head 321). The expandable member 310 includes a conduit 312 that defines a fluid flow path from the expandable member input 311 through the conduit 312 to the brush member input 302. Fluid entering the brush member input 302 may in turn flow through the brush member 301 and out through the hollow bristles 303.

In some embodiments the expandable member 310 is configured to expand and contract in response to a pulsating fluid flow from the source 320 to cause a reciprocating motion of the brush member 301. For example, the expandable member 310 may be an elastic member, e.g., made of an elastomeric material such as molded rubber (e.g., a cast urethane rubber). As shown the, the expandable member 310 includes a pleated accordion feature 313 that allows the member to expand and contract (e.g., in the direction indicated by the bold double ended arrow in FIG. 3B) in response to a pulsating flow of fluid through the expandable member 310. Although in the example shown two ring shaped accordion type pleats are used to form the feature 313, in various embodiments any other suitable number and shape of pleats may be used.

In the embodiment shown, the expandable member input 311 includes a portion of material shaped to fit over a portion of the shower head 321, and may include one or may retention features that facilitate attachment of the expandable member 310 to the shower head 321, e.g., using the connector 330 discussed in detail below.

Some embodiments include a connector 330 configured to attach the expandable member input to the fluid supply source 320 (e.g., as shown, at shower head 321). In some embodiments, the connector 330 is formed as a rigid member. For example, the connector 330 may be made of a rigid plastic such as a rigid nylon (e.g., formed using injection molding or any other suitable technique). As shown, the connector 330 functions as a ring clamp that clamps the expandable member 310 to the surface of the fluid supply source 320 (e.g., to provide a fluid tight fit). However, it is to be understood that any suitable type of connector may be used including, e.g., a screw on connector, a snap fit connector, a friction fit connector, etc.

Figure 4A:
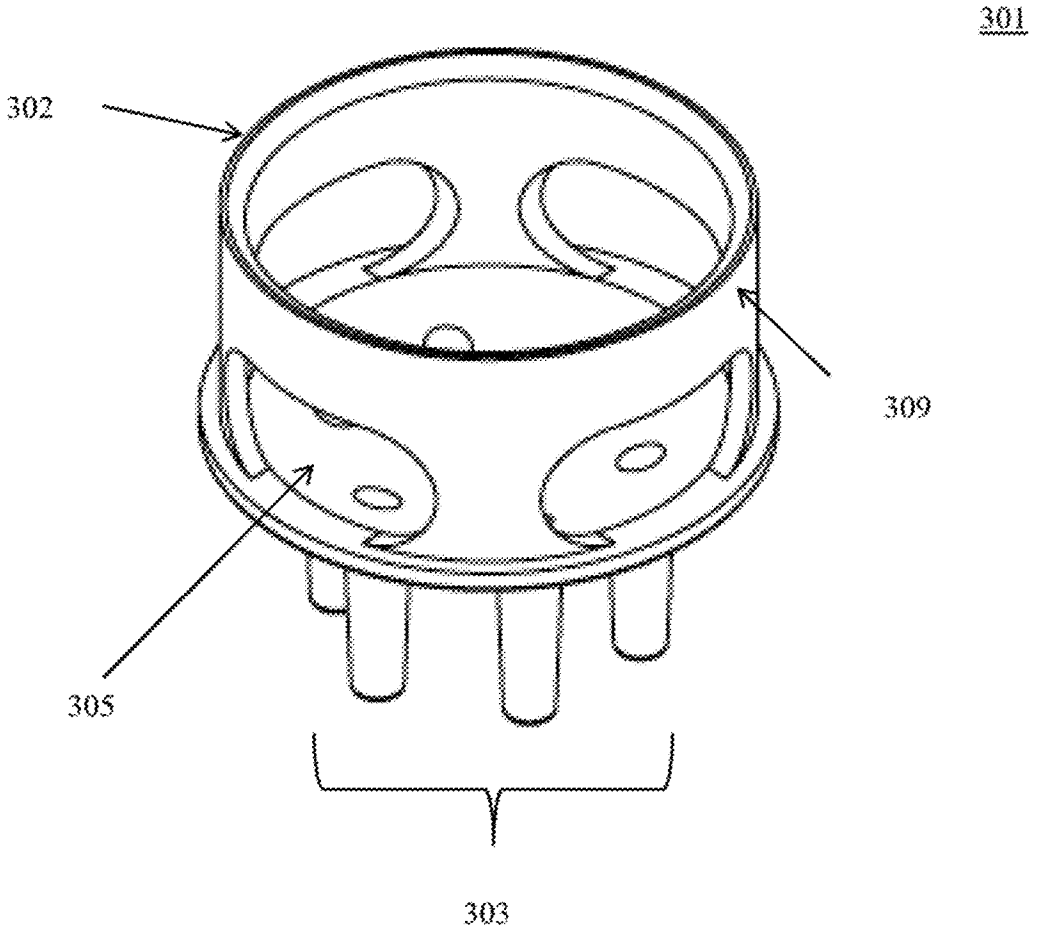
FIGS. 4A-4C show views of a brush member for the massage showerhead of FIGS. 3A-3C.
Figure 4B:
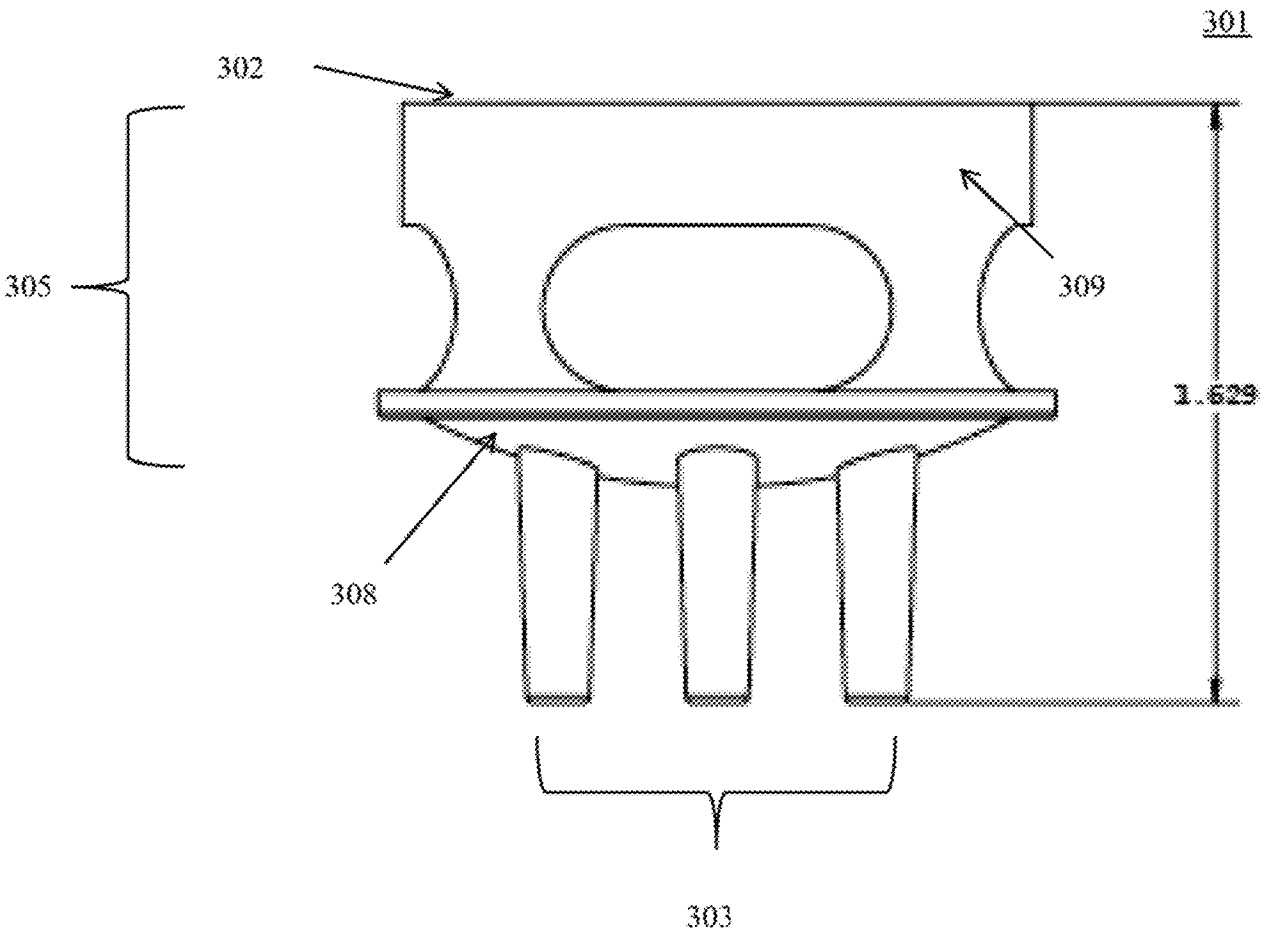
Figure 4C:
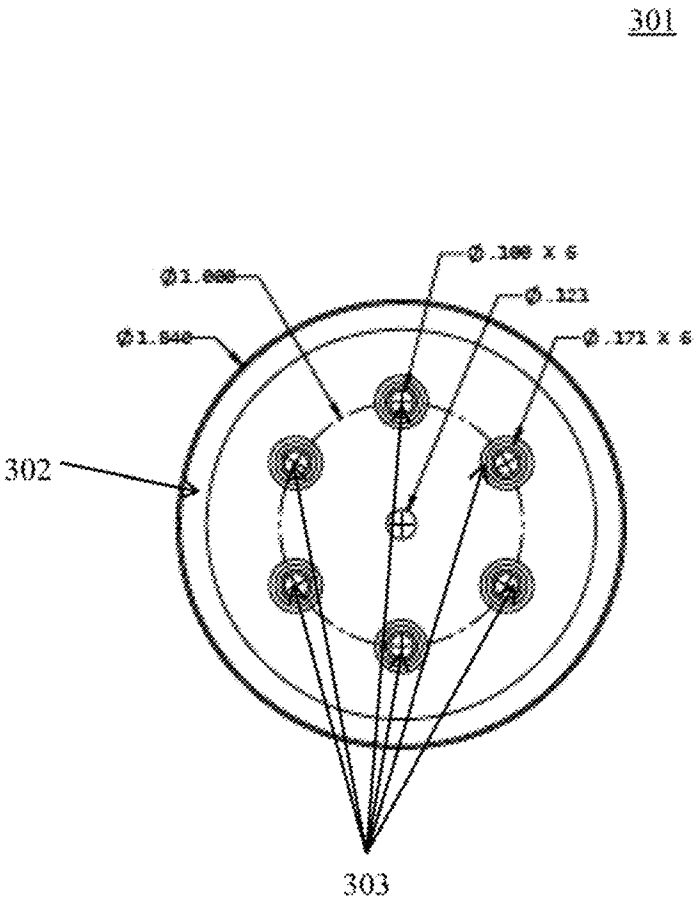
Figure 5A:
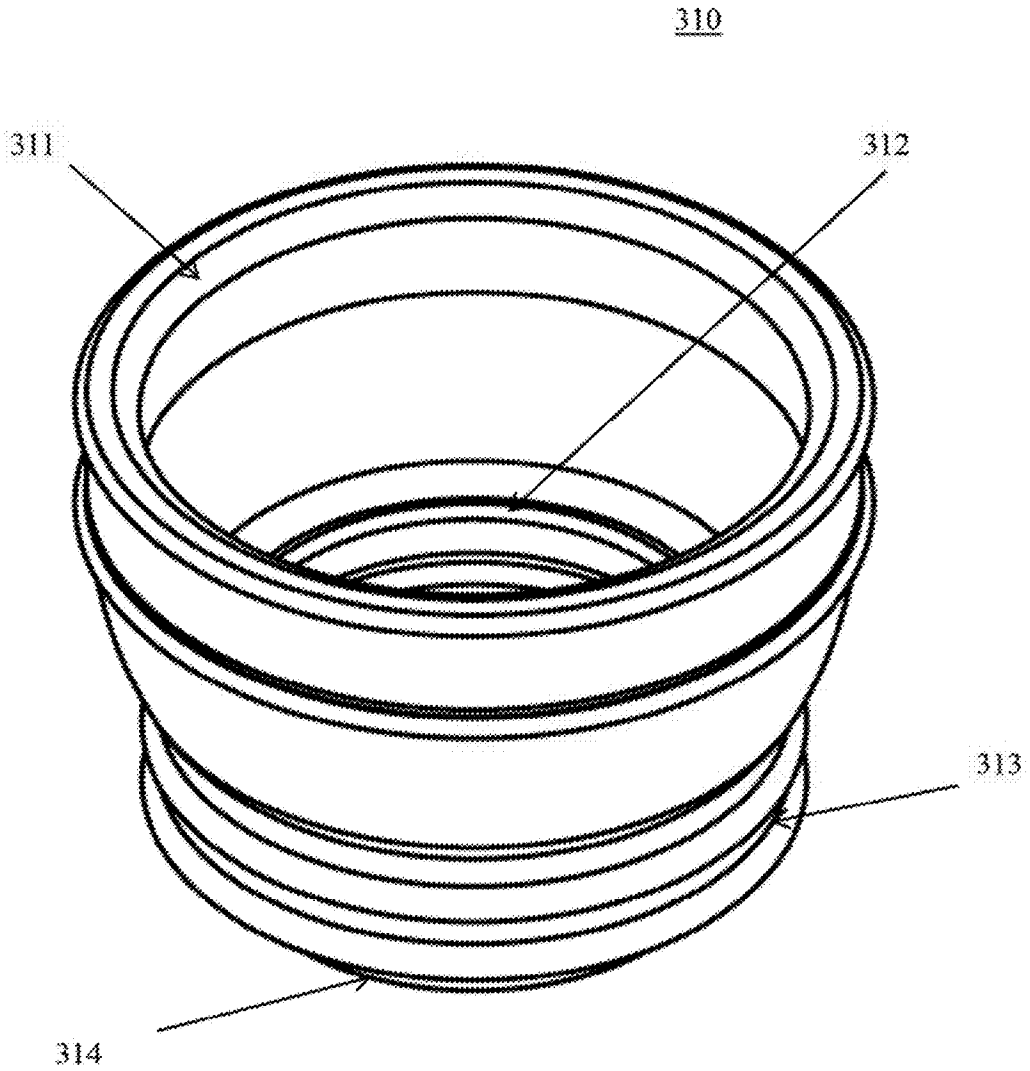
FIGS. 5A-5D show views of a brush member for the massage showerhead.
Figure 5B:
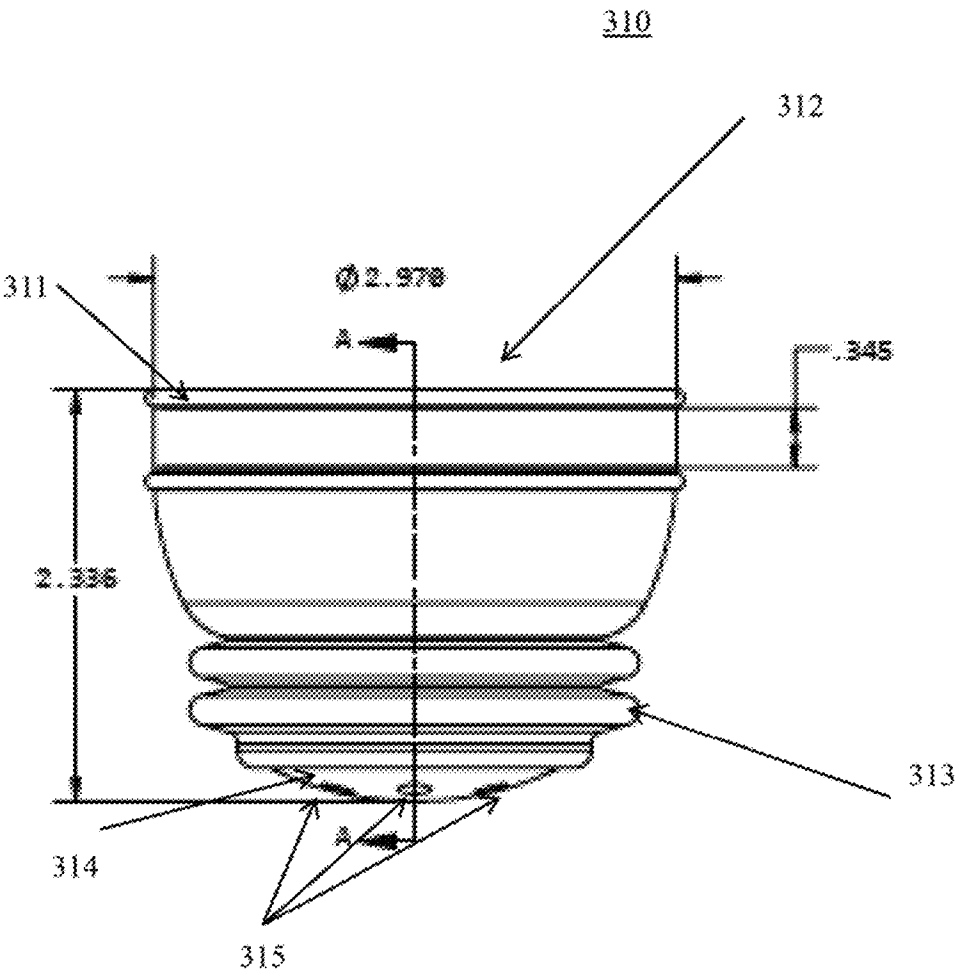
Figure 5C:
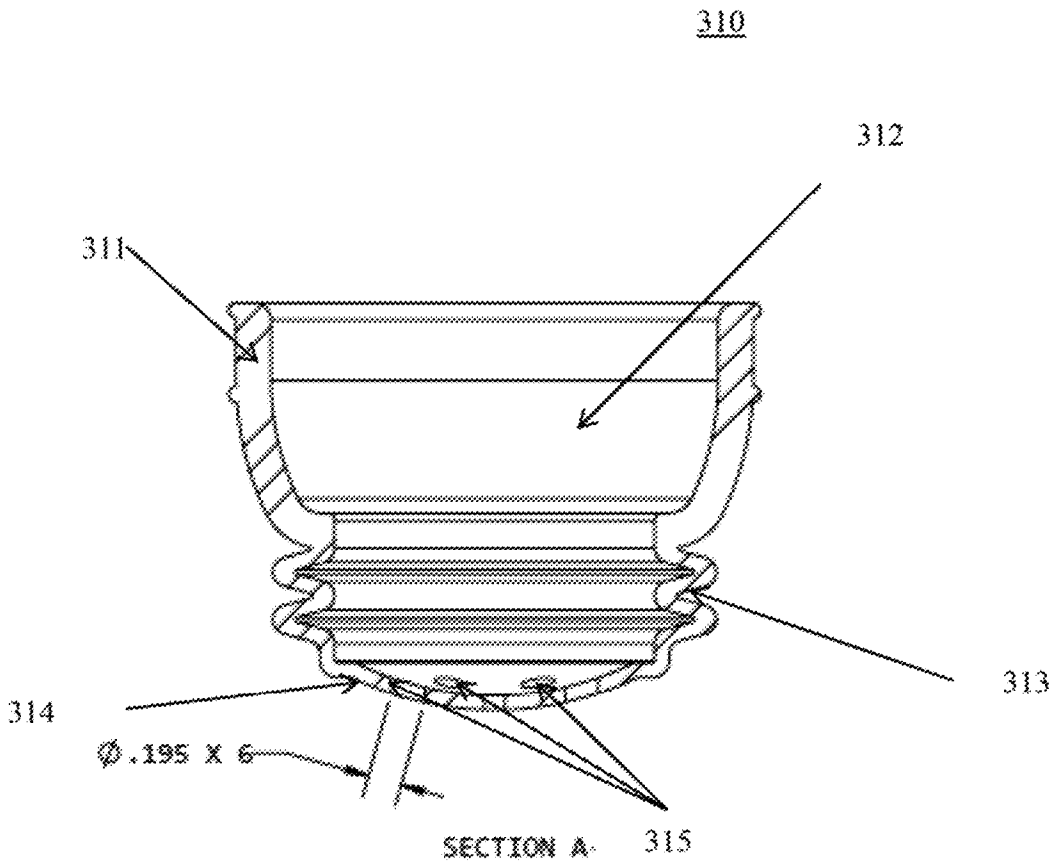
Figure 5D:
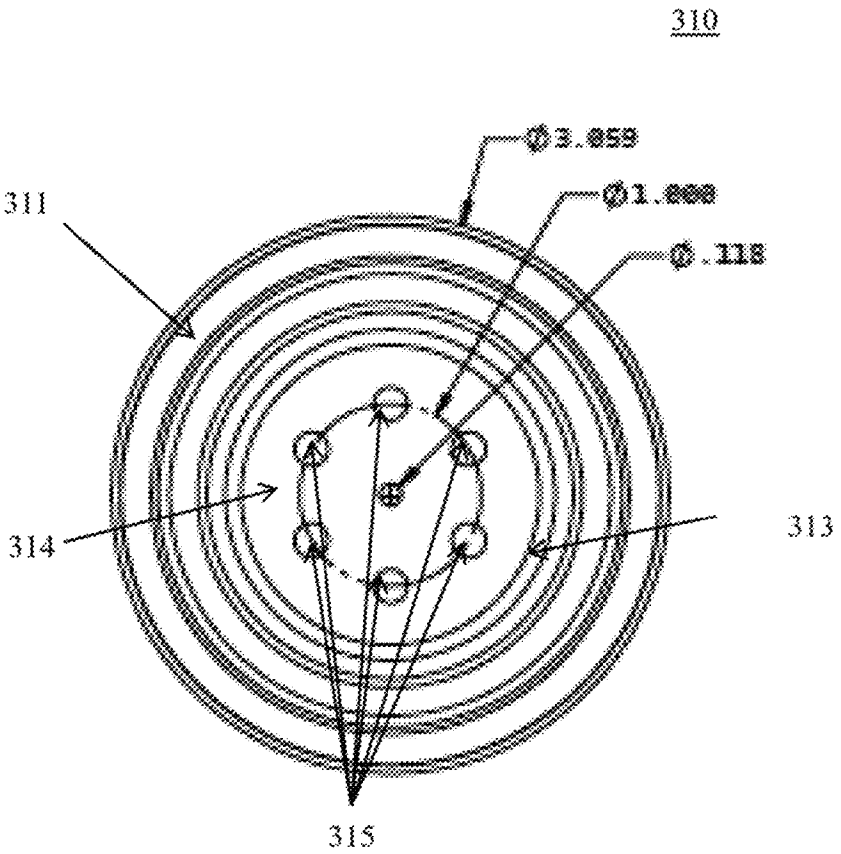

Referring to FIGS. 4A-4C, the brush member 301 includes a main body 305 having an outer surface 308, from which each one of the plurality of bristles 303 projects outward. Although the surface 308 is shown as concave surface, in other embodiments the surface 308 may have any suitable shape, e.g., convex, flat, patterned, irregular, etc.

In the example shown, the plurality of hollow bristles 301 extend transverse to (e.g., perpendicular or is approximately perpendicular to) the surface 308. However, in certain embodiments, the plurality of hollow bristles 303 may have other configurations, e.g., may be inclined towards the surface 308. Furthermore, it should be noted that the plurality of hollow bristles 303 may have variable shapes, curvatures, diameters, and/or lengths. In some embodiments, however, the plurality of hollow bristles 303 may have equal shapes, curvatures, diameters, and/or lengths. Although six bristles are shown, any suitable number or arrangement may be used.

In some embodiments the brush member 301 or a portion thereof (e.g., the main body 305) may be rigid. For example, the e brush member 301 or a portion thereof (e.g., the main body 305) may be made of a rigid plastic such as a rigid nylon (e.g., formed using injection molding or any other suitable fabrication technique). In some embodiments, the hollow bristles 303 may be replaceable or interchangeable.

In various embodiments the plurality of hollow bristles 303 may be rigid, elastic, or a combination thereof. Furthermore, it should be noted that in certain embodiments the plurality of hollow bristles 303 may have variable elasticity.

In various embodiments, the dimensions of the hollow bristles 303 allow for easy penetration of meshes or gaps found between interlocks of hair extensions, or in hair weaves or hair pieces for massaging and washing the users' head scalp. The dimensions and shapes of the hollow bristles 303 may be suitable to fit through various sizes of hair extension meshes and wefting, and the gaps between the interlocks, without damaging them, especially the delicate lace meshes found on men's hairpieces. For example, in some embodiments, each of the bristles 303 may have a diameter in the range of from one sixteenth inch to one half inch or any subrange thereof, e.g., one sixteenth inch to one eight inch.

In the example shown in FIGS. 3A-3C, the expandable member 310 includes a diaphragm portion 314 having a shape (as shown a bowl shape) adapted to receive the main body of the brush member. The diaphragm portion includes a plurality of holes 315 through which each of the plurality of hollow bristles 303 extends as shown in FIGS. 3A-3C. Accordingly, expansion and contraction of the expandable member 310 in response to a pulsating fluid flow will in turn cause the brush member 301 to reciprocate (e.g., in the direction indicated by the bold double arrow in FIG. 3B) while fluid is output through the hollow bristles 303. This reciprocating motion of the brush member 301 may advantageously cause the hollow bristles 303 to penetrate of meshes or gaps found between interlocks of hair extensions, or in hair weaves or hair pieces for massaging and washing the users' head scalp.

As shown in FIGS. 3A-3C and 4A-4C, the main body 305 of the brush member 301 may include a guide portion 309 that may be, e.g., slidably mounted on a portion of the showerhead that operated to guide the reciprocal motion of the brush member 301 (e.g., by preventing unwanted lateral motion, rotational motion, jitter etc.). although the guide member 309 is shown as a ring shape, any other suitable shape (e.g., chosen to match the shape of a feature on the showerhead 321) may be used. In some embodiments, the guide feature 309 may include holes or passages to prevent blockage of fluid flow through the conduit 312 of the expandable member 310.

As shown in FIGS. 3A-3C the fluid supply source 320 includes a showerhead 321. The showerhead 321 may be connected (e.g., via a hose, not shown) to a faucet or other similar fluid source that provides a continuous flow of fluid. The showerhead 321 may include a pulsation device 322 (schematically illustrated in FIG. 3B) that operates on the continuous flow of fluid to generate a pulsating fluid flow (i.e., a fluid flow having a flow rate and/or flow pressure that varies in time, e.g., with a periodic variation). In various embodiments, any suitable fluid pulsation device 322 known in the art may be used including, e.g., a spring loaded valve mechanism.

In some embodiments, the showerhead 321 may be integrated with the expandable member 310, brush member 301, and connector 330. In other embodiments, the expandable member 310, brush member 301, and connector 330 may be a detachable accessory that can be easily connected to and disconnected from the shower head 321.

In various embodiments any suitable type of showerhead 321 may be used, e.g., consumer or salon showerheads with a built-in strong pulsation effect. As shown in FIGS. 3A-3C the showerhead 321 may be a conventional showerhead (e.g., suitable for home use) including a handle (not shown). In other embodiments the showerhead may be for example, a paddle shaped showerhead adapted to be worn on the hand of an operator (as often found in commercial hair salons and similar settings).

In some embodiments, the connector 330, expandable member 310, and brush member 301 are disposed about a longitudinal axis extending from a first end proximal the fluid supply source 320 to a second end distal the fluid supply source, and the reciprocating motion of the brush member includes reciprocation towards and away from the first end proximal the fluid supply source.

In various embodiments, the apparatus 300 (or any component thereof) may include any of the features of the showerhead 100 described in detail above. For example, in certain embodiments, the showerhead 321 may optionally have a hand strap with an optional hand strap adjustment unit (e.g., of the type shown in FIG. 1). Furthermore, the showerhead 321 may optionally have a water pressure regulator, water valve or faucet (not shown) for regulating the pressure of the water flowing through the hollow bristles 303, e.g., from strong to soft or vice versa.

In certain embodiments, the apparatus 300 may optionally have one or more receptacles (not shown) for holding shampoo, conditioning or treatment liquids/products. There may be also an option of a liquid type dispenser (not shown) that may have a dispensing valve or a pumping button e.g., on the showerhead 321. When the dispensing valve is urged under an elastic biasing force (e.g., when the button is pressed), the shampoo, conditioning or treatment liquids/products stored in the one or more receptacles may be released and delivered into the fluid flow through the apparatus 300 for further supply to the user's hair or scalp.

In various embodiments, the showerhead 300 may be operated by providing a pulsating fluid flow to the expandable member input 311 to cause the expandable member 310 to alternately expand and contract in response to the pulsating fluid flow which, in turn, causes a reciprocating motion of the brush member 301 in response to the pulsating fluid flow. Some embodiments include outputting fluid through the plurality of hollow bristles 303 during the reciprocating motion of the brush member 301.

Some embodiments include receiving a steady fluid flow from a steady fluid flow source (e.g., a faucet connected to a plumbed water line) and generating the pulsating fluid flow from the steady fluid flow (e.g., using a showerhead 321 that includes a pulsation device). In some embodiments the frequency, amplitude, or other characteristics of the pulsating flow may be adjusted (e.g., using one or more controls integrated in the shower head 321 or one or more external controls such as a footswitch operatively connected to the source 320).

Although the foregoing refers to particular exemplary embodiments, it will be understood that the invention is not so limited. It will occur to those of ordinary skill in the art that various modifications may be made to the disclosed embodiments and that such modifications are intended to be within the scope of the invention. All of the publications, patent applications and patents cited herein are incorporated herein by reference in their entirety.

What is claimed is:

1. An apparatus comprising:

a brush member comprising a brush member input in fluid communication with a plurality of hollow bristles; and an expandable member comprising:

an expandable member input that receives a pulsating fluid flow from a fluid supply source; and a conduit that defines a fluid flow path from the expandable member input through the conduit to the brush member input;

wherein the expandable member comprises a pleated accordion feature that expands and contracts in response to the pulsating fluid flow to cause a reciprocating motion of the brush member.

2. The apparatus of claim 1, further comprising a connector configured to attach the expandable member input to the fluid supply source.

3. The apparatus of claim 2, wherein the connector comprises a rigid member.

4. The apparatus of claim 3, wherein the connector comprises a ring clamp adapted to clamp the expandable member to one or more surfaces of the fluid supply source.

5. The apparatus of claim 2, wherein:

the connector, expandable member, and brush member are disposed about a longitudinal axis extending from a first end proximal the fluid supply source to a second end distal the fluid supply source, and the reciprocating motion of the brush member comprises reciprocation towards and away from the first end proximal the fluid supply source.

6. The apparatus of claim 1, wherein the expandable member is an elastic member.

7. The apparatus of claim 1, wherein the expandable member input is configured to receive a pulsating fluid flow from a fluid supply source that comprises a showerhead comprising a pulsation device configured to generate the pulsating fluid flow.

8. The apparatus of claim 7, further comprising the showerhead.

9. The apparatus of claim 1, wherein the brush member comprises a rigid main body having at least one surface, and wherein each one of the bristles from the plurality of hollow bristles project outward from a surface of the main body.

10. The apparatus of claim 9, wherein the plurality of hollow bristles includes bristles of variable length.

11. The apparatus of claim 9, wherein each one of the bristles from the plurality of hollow bristles projects outward from a surface of the main body of the brush member having a curved shape.

12. The apparatus of claim 11, wherein the expandable member comprises a diaphragm adapted to receive the main body of the brush member, wherein the diaphragm comprises a plurality of holes through which each of the plurality of hollow bristles extends.

13. The apparatus of claim 1, wherein the brush member is a rigid member.

14. The apparatus of claim 1, wherein the hollow bristles are dimensioned such that the hollow bristles may penetrate a mesh and/or gap in at least one of an interlock of a hair extension, a hair weave, and a hair piece without damaging the at least one of an interlock of a hair extension, a hair weave, and a hair piece.

15. A method comprising:

providing an apparatus comprising:

a brush member comprising a brush member input in fluid communication with a plurality of hollow bristles; and an expandable member comprising:

an expandable member input that receives a pulsating fluid flow from a fluid supply source; and a conduit that defines a fluid flow path from the expandable member input through the conduit to the brush member input;

providing a pulsating fluid flow to the expandable member input to cause a pleated accordion feature of the expandable member to alternately expand and contract in response to the pulsating fluid flow; and causing a reciprocating motion of the brush member by the expansion and contraction of the expandable elastic member in response to the pulsating fluid flow.

16. The method of claim 15, comprising outputting fluid through the plurality of hollow bristles during the reciprocating motion of the brush member.

17. method of claim 16, further comprising:

receiving a steady fluid flow from a steady fluid flow source; and generating the pulsating fluid flow from the steady fluid flow.

18. The method of claim 17, wherein the generating the pulsating fluid flow from the steady fluid flow comprises:

providing a showerhead comprising a pulsation device; and directing the steady fluid flow to the pulsation device to generate a pulsating fluid flow.

19. The method of claim 15, further comprising:

washing a user's head scalp using the apparatus while the hollow bristles penetrate a mesh and/or gap in at least one of an interlock of a hair extension, a hair weave, and a hair piece secured to the user's head scalp.

* * * * *